US006315584B1

(12) United States Patent
Greenside et al.

(10) Patent No.: US 6,315,584 B1
(45) **Date of Patent: *Nov. 13, 2001**

(54) PROTECTIVE COVER FOR A PRINTED CIRCUIT BOARD ELECTRICAL CONNECTOR

(75) Inventors: Michael J. Greenside, Granite Bay; Gregory S. Meyer; Donald G. Pauser, both of Roseville, all of CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/539,285

(22) Filed: Mar. 30, 2000

(51) Int. Cl.[7] ..... H01R 13/44
(52) U.S. Cl. ..... 439/135; 439/940
(58) Field of Search ..... 439/135, 136, 439/148, 149, 940

(56) References Cited

U.S. PATENT DOCUMENTS

| | | | | |
|---|---|---|---|---|
| 4,396,245 | | 8/1983 | Lane | 339/38 |
| 4,731,032 | | 3/1988 | Noorily | 439/136 |
| 4,795,354 | * | 1/1989 | Owen | 439/137 |
| 5,030,120 | | 7/1991 | Hartley | 439/144 |
| 5,466,164 | | 11/1995 | Miyazaki et al. | 439/140 |
| 5,756,937 | * | 5/1998 | Gleadall | 174/138 F |
| 5,997,318 | | 12/1999 | Chou | 439/136 |
| 6,083,016 | * | 7/2000 | Waynick, Sr. | 439/135 |
| 6,116,949 | * | 9/2000 | Costello et al. | 439/509 |

* cited by examiner

*Primary Examiner*—Gary Paumen
*Assistant Examiner*—Ross Gushi

(57) ABSTRACT

A protective cover for attachment to an electrical connector having a pair of spaced, parallel upstanding walls with a plurality of exposed electrical contacts disposed between inner surfaces of the upstanding walls. The protective cover includes a planar top wall, a pair of spaced, parallel planar side walls and a pair of spaced, parallel planar end walls. The planar side and end walls engage the outer surfaces of the upstanding walls of the electrical connector to removably secure the protective cover to the electrical connector such that the protective cover enshrouds the electrical contacts to protect the electrical contacts from damage and prevent accumulation of dust particles on the electrical contacts. Each of the planar side and end walls has a lower free edge that is radiused to form a lead-in feature that aids in aligning and sliding the protective cover onto the upstanding walls of the electrical connector. The planar top, side and end walls are formed of a semi-rigid vinyl plastic film having static charge dissipative characteristics.

20 Claims, 3 Drawing Sheets

PROTECTIVE COVER FOR A PRINTED CIRCUIT BOARD ELECTRICAL CONNECTOR

BACKGROUND OF THE INVENTION

This invention relates to electrical connectors for printed circuit boards. In particular, the present invention is a dust/protective cover that is removably attached to a printed circuit board electrical connector having a plurality of exposed pin terminals. The dust/protective cover prevents pin terminal damage, electrostatic discharge damage, and the collection of dust in the electrical connector that can render the electrical connector useless or diminish the overall quality of the electrical connector.

Electrical connectors are widely used in the electronics industry in a variety of products including computers and telecommunication devices. One such electrical connector is the generically known "2 mm Hard Metric (HM) Electrical Connector". This type of electrical connector is manufactured by various companies. On such manufacturing organization is Amp Incorporated of Harrisburg, Pa. which manufactures a 2 mm HM connector under its Z-PACK trademark. Typically, one or more of these 2 mm HM electrical connectors are mounted to a printed circuit board (PCB) to allow the PCB to be electrically connected (i.e., plugged) to a mother board, input/output (I/O) cards, other PCB's and/or other electrical components. These 2 mm HM connectors include a plurality of pin terminals (i.e., male connector) that are plug compatible with socket terminals (i.e., female connector) of a corresponding compatible connector to allow data and/or power to be transmitted between the joined components.

Although the coupling of the pin terminals with the socket terminals forms a reliable electrical connection, there arc some drawbacks in the use of pin/socket electrical interconnects. For example, once the 2 mm HM connectors are attached to a PCB, the pin terminals of the 2 mm HM connectors are subject to damage during normal handling, as a result of repeated electrical connects and disconnects, and/or during process development. Pin damage renders the electrical connector useless, and repair of the electrical connector (if possible) is time consuming and costly. As such, operational PCB's having 2 mm HM connectors with damaged pin terminals are often replaced simply because of the damaged pins.

In addition, over time, empty 2 mm HM connectors that will eventually get an I/O card (or any other additional PCB connection), and 2 mm HM connectors of PCB's in storage are subject to dust collection. The accumulation of dust on the pin terminals of these 2 mm HM electrical connectors can cause a loss of electrical contact in one or more of the terminal pins when mated with the corresponding compatible female connector. This loss of electrical contact may cause start-up problems, intermittent operation or total inoperability, thereby causing the overall quality of the electronic device, incorporating the dust affected electrical connectors, to be diminished.

Moreover, these 2 mm HM connectors, the PCB's to which these connectors are mounted and other electronic components mounted to the PCB's are susceptible to electrostatic discharge (ESD). ESD is caused when the electrical potential of an individual is different from that of an electronic device. When the individual touches a 2 mm HM connector, for example, this electrical potential difference manifests itself as an electric spike to the connector. This spike can jump from the connector to the PCB and the electronic components causing damage to sensitive electronics. This ESD caused damage can adversely affect the overall operation of the electronic device or cause the electronic device to become inoperable, thereby necessitating time consuming and costly repairs.

There is a need for a protective cover for PCB electrical connectors. In particular, there is a need for a protective cover for an electrical connector that prevents pin terminal damage, ESD damage, and the collection of dust in the electrical connector that can render the electrical connector, its associated PCB and electronic components useless or diminish the overall quality of the electronic device incorporating these components. The protective cover should reliably provide these features so as to preclude time consuming and costly repairs of the electrical connector and the associated PCB's and electronic components. In addition, the protective cover should be readily removable from and replaceable on the electrical connector. Lastly, the protective cover should be relatively easy and inexpensive to manufacture, and relatively simple to install onto electrical connectors for PCB's.

SUMMARY OF THE INVENTION

The present invention is a protective cover for attachment to an electrical connector. The electrical connector has a pair of spaced, parallel upstanding walls with a plurality of exposed electrical contacts disposed therebetween. Each upstanding wall has an inner surface adjacent the electrical contacts and an opposite outer surface. The protective cover includes a generally planar top wall and a pair of spaced, parallel generally planar side walls. The planar side walls extend outwardly from a peripheral edge of the top wall. The pair of planar side walls engage the outer surfaces of the upstanding walls of the electrical connector to removably secure the protective cover to the electrical connector such that the protective cover enshrouds the electrical contacts to protect the electrical contacts from damage and prevent accumulation of dust particles on the electrical contacts.

In one aspect of the present invention, the protective cover includes a pair of spaced, parallel generally planar end walls that extend outwardly from the peripheral edge of the planar top wall and are secured to both adjacent side walls. In another aspect of the present invention, each of the planar side walls and end walls has a lower free edge opposite the peripheral edge of the top wall, with these lower free edges being radiused to form a lead-in feature that aids in aligning and sliding the protective cover onto the pair of upstanding walls of the electrical connector. In a further aspect of the present invention, the top, side and end walls are sized to form a tight interference fit over a plurality of the electrical connectors that are arranged end to end to completely enshroud the electrical contacts of the plurality of electrical connectors to protect the electrical contacts from damage and prevent accumulation of dust particles on the electrical contacts. In still a further aspect of the present invention, the planar top, side and end walls are formed of a semi-rigid vinyl plastic film having static charge dissipative characteristics.

In another embodiment, the present invention provides in combination an electrical connector for a printed circuit board and a static dissipative protective cover in removable attachment with the electrical connector. The electrical connector includes a base wall, a pair of spaced, parallel upstanding walls extending from the base wall, and a plurality of exposed electrical contacts disposed on the base wall. Each upstanding wall has an inner surface and an opposite outer surface with the electrical contacts disposed between the inner surfaces of the upstanding walls. The static dissipative protective cover includes a generally planar top wall, a pair of spaced, parallel generally planar side walls and a pair of spaced, parallel generally planar end walls. The planar side and end walls extend outwardly from a peripheral edge of the planar top wall. Each planar end wall is secured to both adjacent side walls. The pair of planar side and end walls engage the upstanding walls of the electrical connector to removably attach the protective cover to the electrical connector such that the protective cover completely enshrouds the electrical contacts to protect the electrical contacts from damage and prevent accumulation of dust particles on the electrical contacts.

The protective cover of the present invention completely enshrouds the electrical contacts, and thereby prevents electrical contact damage, electrostatic discharge damage, and the collection of dust in the electrical connector that can render the electrical connector, its associated printed circuit board and electronic components useless or diminish the overall quality of the electronic device incorporating these components. The protective cover reliably provides these features so as to preclude time consuming and costly repairs of the electrical connector and the associated printed circuit boards and electronic components. In addition, the protective cover is readily removable from and replaceable on the electrical connector. Lastly, the protective cover is relatively easy and inexpensive to manufacture, and is simple to initially install onto electrical connectors for printed circuit boards due to the lead-in features provided by the radiused free edges of the planar side and end walls.

BRIEF DESCRIPTION OF THE DRAWINGS

The accompanying drawings arc included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
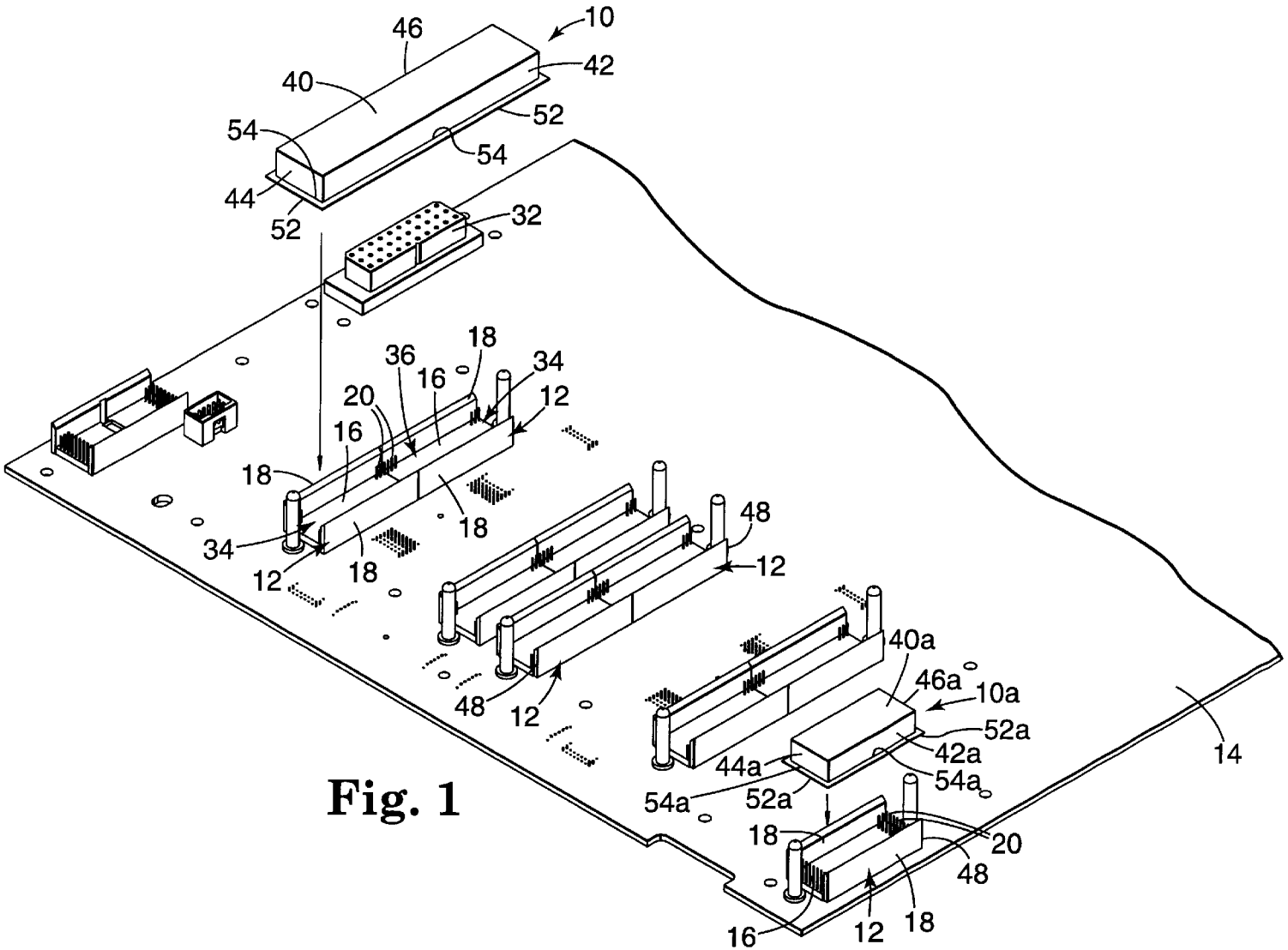
FIG. 1 is a perspective view illustrating first and second exemplary embodiments of protective covers, in accordance with the present invention, sized to fit over a pair of electrical connectors and a single electrical connector mounted to a printed circuit board.
Figure 3:
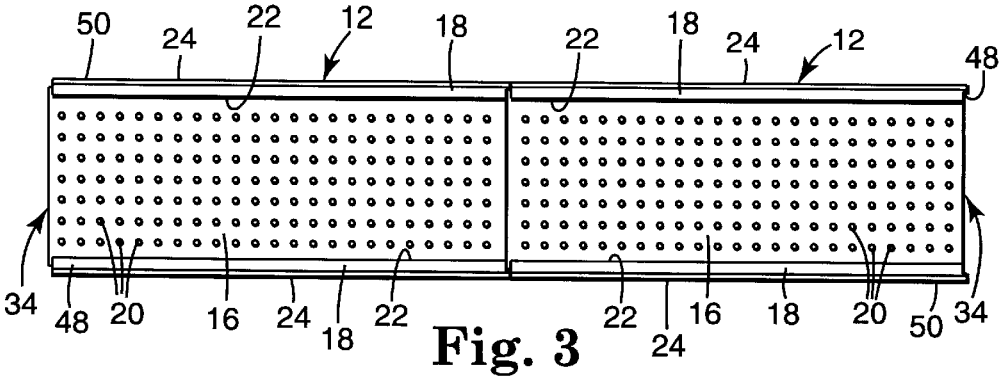
FIG. 3 is a top elevational view of the two electrical connectors arranged end to end shown in FIG. 1.
Figure 4:
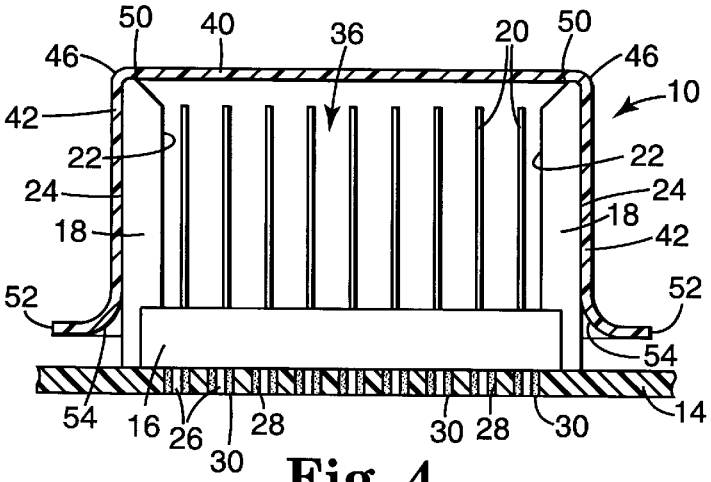
FIG. 4 is a greatly enlarged sectional view of the first embodiment of the protective cover, in accordance with the present invention mounted on the two electrical connectors arranged end to end shown in FIG. 3.
Figure 5:
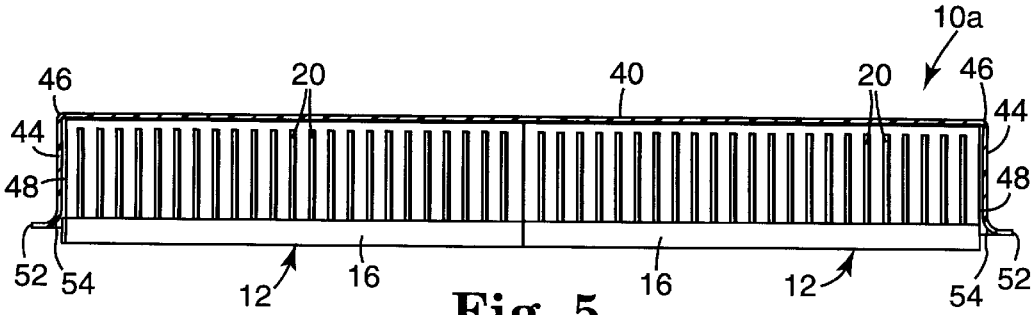
FIG. 5 is a sectional view rotated 90° from FIG. 4 further illustrating the first embodiment of the protective cover, in accordance with the present invention mounted on the two electrical connectors arranged end to end.

A first embodiment of a protective cover 10 for removable attachment to an electrical connector 12 mounted to a printed circuit board (PCB) 14, in accordance with the present invention, is illustrated generally in FIGS. 1, 4 and 5. As seen best in FIGS. 1, 3 and 4, the electrical connector 12 is of the type that includes a base wall 16 and a pair of spaced, parallel upstanding walls 18 that extend upwardly from and are substantially perpendicular to the base wall 16. A plurality of electrical contacts, such as pin terminals 20, are arranged in parallel rows on the base wall 16. As seen best in FIGS. 3 and 4, each upstanding wall 18 has an inner surface 22 and an opposite outer surface 24. The pin terminals 20 are disposed between the inner surfaces 22 of the upstanding walls 18. As seen in FIG. 4, terminal contacts 26 of the pin terminals 20 extend through the base wall 16 of the electrical connector 12 and into holes 28 in the PCB 14. Typically, these terminal contacts 26 of the pin terminals 20 are secured within the holes 28 of the PCB 14 via a press fit engagement or solder (solder 30 being illustrated in FIG. 4) to form an electrical connection between the pin terminals 20 of the electrical connector 12 and electronic components 32 (see FIG. 1) mounted to the PCB 14. As can be seen in FIGS. 1 and 3, the pin terminals 20 of the electrical connector 12 are completely exposed at open ends 34 and open top 36 of the upstanding walls 18. As such, the pin terminals 20 are susceptible to pin damage and dust accumulation.

The above described electrical connector is generically known as a "2 mm Hard Metric (HM) Electrical Connector". A 2 mm HM electrical connector of this type is manufactured by Amp Incorporated of Harrisburg, Pa. under its Z-PACK trademark.

Figure 2:
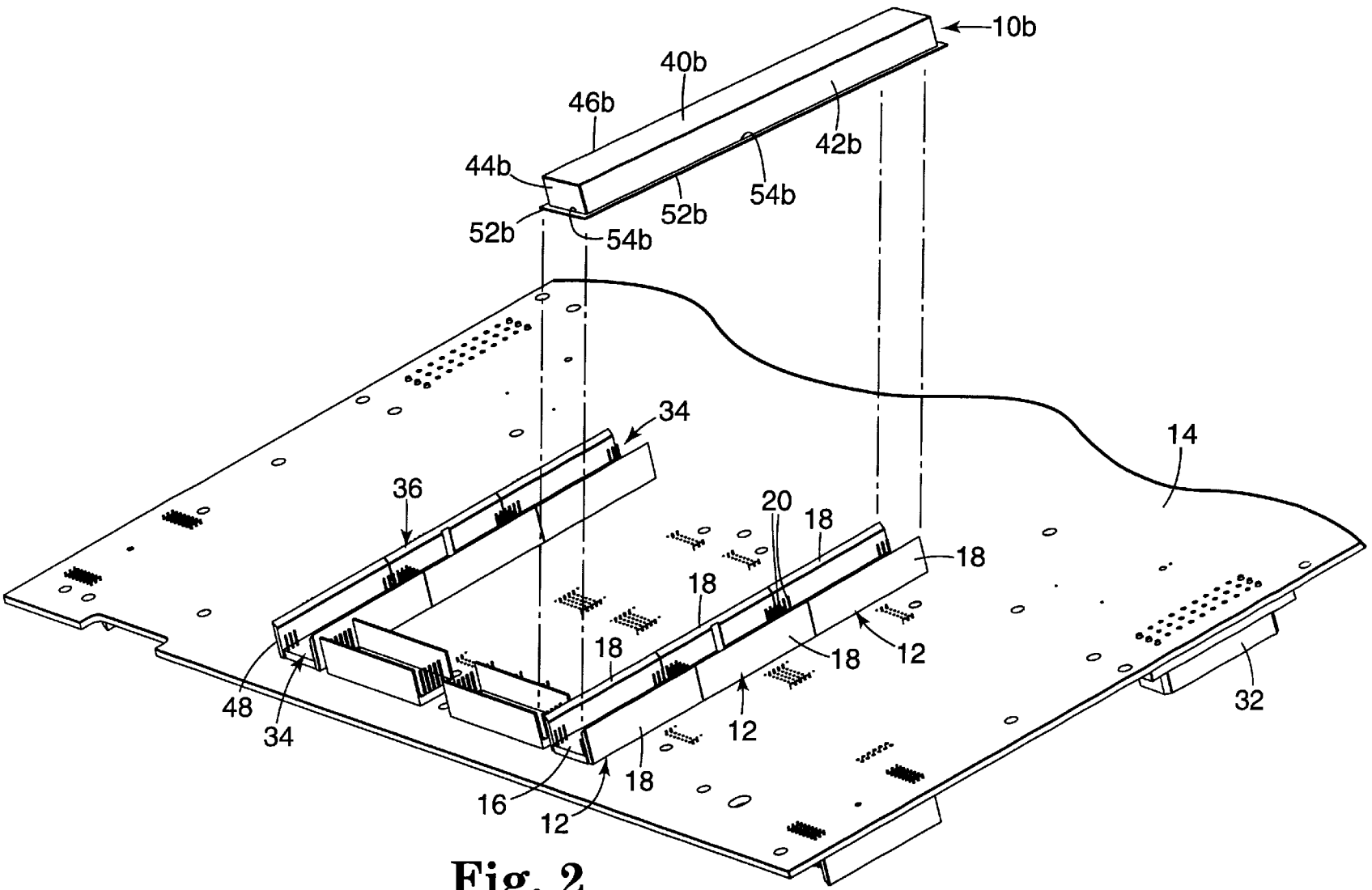
FIG. 2 is a perspective view similar to FIG. 1 illustrating a third embodiment of a protective cover, in accordance with the present invention, sized to fit over a three electrical connectors mounted to a printed circuit board.

These electrical connectors 12 are capable of being "ganged" together end-to-end at their open ends 34 to form connectors having a desired number of pin terminals 20. For example the left hand side of FIG. 1 and FIGS. 3 and 5 illustrate two of the electrical connectors 12 arranged end-to-end. The right hand side of FIG. 1 illustrates a single electrical connector 12, and FIG. 2 illustrates three of the electrical connectors 12 arranged end-to-end.

The first embodiment of the protective cover 10, in accordance with the present invention, for removable attachment to a pair of electrical connectors 12 arranged end-to-end is illustrated in FIGS. 1 and 3–5 and will be described with particularity. The protective cover 10 includes a generally planar top wall 40, a pair of spaced, parallel generally planar side walls 42 and a pair of spaced, parallel generally planar end walls 44. The planar side and end walls 42, 44 extend outwardly from a peripheral edge 46 of the planar top wall 40. In addition, the planar side and end walls 42, 44 are substantially perpendicular to the planar top wall 40. As seen best in FIG. 1, each planar side wall 42 is integrally joined to both adjacent end walls 44. In addition, the planar side and end walls 42, 44 are integrally joined with the planar top wall 40 at the peripheral edge 46. As such, the planar top, side and end walls 40, 42, 44 that define the protective cover 10 form a single, unitary structure.

As seen best in FIGS. 4 and 5, the top, side and end walls 40, 42, 44 are sized to form a tight interference fit over the upstanding walls 18 of the pair of end-to-end arranged electrical connectors 12. In particular, the planar side walls 42 engage the outer surfaces 24 of the upstanding walls 18 of the electrical connectors 12, while the planar end walls 46 engage end edges 48 (see FIG. 5) of the upstanding walls 18 of the electrical connectors 12. In addition, the planar top wall 40, engages upper edges 50 (FIG. 4) of the upstanding walls 18 of the electrical connectors 12. This tight interference fit between the planar top, side and end walls 40, 42, 44 of the protective cover 10 and the upstanding walls 18 of the electrical connectors 12 ensures that the protective cover 10 is adequately secured to the electrical connectors 12 so as to prevent unintentional or unplanned removal of the protective cover 10 from the electrical connectors 12 such as may occur during handling of the PCB 14. However, this snug interference fit still allows a user to readily remove the protective cover 10 from the electrical connectors 12 when access to the electrical connectors 12 is desired.

As can be seen in FIGS. 4 and 5, with the protective cover positioned on the upstanding walls 18 of the electrical connectors 12, the planar top, side and end walls 40, 42, 44 completely enshrouds the pin terminals 20 of the pair of end-to-end arranged electrical connectors 12 to protect the pin terminals 20 from damage and prevent accumulation of dust particles on the pin terminals 20. To aid in aligning and sliding the protective cover 10 onto the upstanding walls 18 of the pair of end-to-end arranged electrical connectors 12 (such as required during initial installation or replacement of the protective cover 10 onto the electrical connectors 12), each of the planar side and end walls 42, 44 has a lower free edge 52, opposite the peripheral edge 46 of the top wall 40, that is radiused (i.e., curved outwardly) to form a lead-in feature 54. The lead-in features 54 of the planar side and end walls 42, 44 function to allow the protective cover 10 to be easily aligned with the upstanding walls 18 of the electrical connectors 12 and function to guide the protective cover 10 over the upstanding walls 18 during installation.

In addition to preventing damage to the pin terminals 20 of the electrical connectors 12 and the accumulation of operation affecting duct particles on the pin terminals 10, the protective cover 10 also protects the electrical connectors 12, as well as the PCB's 14 and the electronic components 32, from damage caused by electrostatic discharge (ESD). To affect this protection, the protective cover 10 is manufactured from a material having static charge dissipative characteristics.

In one preferred embodiment, the single unitary structure that defines the protective cover 10 is vacuum formed from a semi-rigid piece of vinyl plastic film having a thickness of 0.020 inches. This vinyl plastic film has static charge dissipative characteristics and is available from Klockner Pentaplast of America, Inc. (Gordonsville, Va.) under the part name PENTASTAT SC 760/05.

A second embodiment protective cover 10*a* is also illustrated in FIG. 1. In this second embodiment protective cover 10*a* like parts are labeled with like numerals with the addition of the subscript "a". This second embodiment protective cover 10*a* is identical to the first embodiment protective cover 10 except that it is smaller in size to as to only cover a single electrical connector 12.

In addition, a third embodiment protective cover 10*b* is illustrated in FIG. 2. In this third embodiment protective cover 10*b* like parts are labeled with like numerals with the addition of the subscript "b". This third embodiment protective cover 10*b* is identical to the first embodiment protective cover 10 except that it is larger in size to as to cover three end-to-end arranged electrical connectors 12.

The protective covers 10, 10*a*, 10*b* of the present invention completely enshroud the pin terminals 20, and thereby prevent pin terminal damage, ESD damage, and the collection of dust in the electrical connectors 12 that can render the electrical connectors 12, their associated PCB's 14 and electronic components 32 useless or diminish the overall quality of the electronic device incorporating these components. The protective covers 10, 10*a*, 10*b* reliably provide these features so as to preclude time consuming and costly repairs to the electrical connectors 12 and the associated PCB's 14 and electronic components 32. In addition, the protective covers 10, 10*a*, 10*b* are readily removable from and replaceable on the electrical connectors 12. Lastly, the protective covers 10, 10*a*, 10*b* are relatively easy and inexpensive to manufacture, and are simple to initially install onto electrical connectors 12 for PCB's 14 due to the lead-in features 54 provided by the radiused free edges 52 of the planar side and end walls 42, 44.

Although the present invention has been described with reference to preferred embodiments, workers skilled in the art will recognize that changes may be made in form and detail without departing from the spirit and scope of the invention.

What is claimed is:

1. A protective cover for attachment to an electrical connector having a pair of spaced, parallel upstanding walls with a plurality of exposed electrical contacts disposed therebetween, each upstanding wall having an inner surface adjacent the electrical contacts and an opposite outer surface, the protective cover comprising:

a generally planar top wall having a peripheral edge, wherein the top wall is continuous so as to be free from any openings; and a pair of spaced, parallel generally planar side walls extending outwardly from the peripheral edge of the top wall, with each of the planar side walls having a lower free edge opposite the peripheral edge of the top wall, wherein each lower free edge is curved outwardly and has a free end that is perpendicular to its respective planar side wall so as to form a plurality of lead-in features that aid in aligning and sliding the protective cover onto the pair of upstanding walls of the electrical connector, wherein the pair of side walls are sized to engage and form a tight interference fit with the outer surfaces of the upstanding walls of the electrical connector, and wherein the tight interference fit alone acts to removably secure the protective cover to the electrical connector, the protective cover having a mounted state, wherein the protective cover is mounted to the electrical connector such that the protective cover enshrouds the electrical contacts to protect the electrical contacts from damage, prevent accumulation of dust particles on the electrical contacts, and prevent access to the electrical contacts and thereby use of the electrical connector, and a removed state, wherein the protective cover is removed from the electrical connector to allow access to the electrical contacts and thereby use of the electrical connector.

2. The protective cover of claim 1 wherein each planar side wall of the pair of planar side walls is substantially perpendicular to the planar top wall.

3. The protective cover of claim 1 wherein the electrical connector is a 2 mm hard metric electrical connector.

4. The protective cover of claim 1, and further including:

a pair of spaced, parallel generally planar end walls extending outwardly from the peripheral edge of the top wall, the top wall, side walls and end walls in the mounted state of the protective cover completely enshrouding the electrical contacts to protect the electrical contacts from damage, prevent accumulation of dust particles on the electrical contacts, and prevent access to the electrical contacts and thereby use of the electrical connector.

5. The protective cover of claim 4 wherein each of the planar end walls has a lower free edge opposite the peripheral edge of the top wall, and wherein each of the lower free edges of the planar end walls is curved outwardly and has a free end that is perpendicular to its planar end wall so as to form a lead-in feature that aids in aligning and sliding the protective cover onto the pair of upstanding walls of the electrical connector.

6. The protective cover of claim 4 wherein the pair of planar end walls engage end edges of the upstanding walls of the electrical connector to removably secure the protective cover to the electrical connector.

7. The protective cover of claim 6 wherein the planar end walls are sized to engage and form the tight interference fit with the end edges of the pair of upstanding walls of the electrical connector to removably secure the protective cover to the electrical connector.

8. The protective cover of claim 6 wherein each planar side wall of the pair of planar side walls, and each planar end wall of the pair of planar end walls is substantially perpendicular to the planar top wall.

9. The protective cover of claim 8 wherein each planar side wall is secured to both adjacent end walls.

10. The protective cover of claim 9 wherein the top wall, side walls and end walls form a single, unitary structure.

11. The protective cover of claim 10 wherein the single unitary structure is vacuum formed.

12. The protective cover of claim 4 wherein the top, side and end walls are formed of a semi-rigid vinyl plastic film.

13. The protective cover of claim 12 wherein the plastic film has static charge dissipative characteristics.

14. The protective cover of claim 4 wherein the top, side and end walls are sized to form the tight interference fit over a plurality of the electrical connectors that are arranged end to end, such that in the mounted state of the protective cover, the protective cover completely enshrouds the electrical contacts of the electrical connectors to protect the electrical contacts from damage, prevent accumulation of dust particles on the electrical contacts, and prevent access to the electrical contacts and thereby use of the electrical connectors.

15. The protective cover of claim 14 wherein the top, side and end walls are sized to form the tight interference fit over three of the electrical connectors that are arranged end to end.

16. In combination:

an electrical connector for a printed circuit board, the electrical connector including:

a base wall;

a pair of spaced, parallel upstanding walls extending from the base wall, each upstanding wall having an inner surface, an opposite outer surface, and edge surfaces; and a plurality of exposed electrical contacts disposed on the base wall between the inner surfaces of the upstanding walls; and a static dissipative protective cover removably attachable to the electrical connector, the protective cover including:

a generally planar top wall having a peripheral edge, wherein the top wall is continuous so as to be free from any openings;

a pair of spaced, parallel generally planar side walls extending outwardly from the peripheral edge of the top wall; and a pair of spaced, parallel generally planar end walls extending outwardly from the peripheral edge of the top wall, each planar end wall being secured to both adjacent side walls, with each of the planar side and end walls having a lower free edge opposite the peripheral edge of the top wall, wherein each lower free edge is curved outwardly and has a free end, each free end of the planar side walls being perpendicular to its respective planar side wall and each free end of the planar end walls being perpendicular to its respective planar end wall so as to form a plurality of lead-in features that aid in aligning and sliding the protective cover onto the pair of upstanding walls of the electrical connector, wherein at least the pair of side walls are sized to engage and form a tight interference fit with the outer surfaces of the pair of upstanding walls of the electrical connector, and wherein the tight interference fit alone acts to removably attach the protective cover to the electrical connector, the protective cover having a mounted state, wherein the protective cover is mounted to the electrical connector such that the protective cover completely enshrouds the electrical contacts to protect the electrical contacts from damage, prevent accumulation of dust particles on the electrical contacts, and prevent access to the electrical contacts and thereby use of the electrical connector, and a removed state, wherein the protective cover is removed from the electrical connector to allow access to the electrical contacts and thereby use of the electrical connector.

17. The combination of claim 16 wherein the top, side and end walls are sized to form the tight interference fit over a plurality of the electrical connectors that are arranged end to end, such that in the mounted state of the protective cover, the protective cover completely enshrouds the electrical contacts of the electrical connector to protect the electrical contacts from damage, prevent accumulation of dust particles on the electrical contacts, and prevent access to the electrical contacts and thereby use of the electrical connector.

18. The combination of claim 16 wherein the top, side and end walls are formed of a semi-rigid vinyl plastic film having static charge dissipative characteristics.

19. A protective cover for attachment to an electrical connector having a pair of spaced, parallel upstanding walls with a plurality of exposed electrical contacts disposed therebetween, each upstanding wall having an inner surface adjacent the electrical contacts and an opposite outer surface, the protective cover comprising:

a generally planar top wall having a peripheral edge, wherein the top wall is continuous so as to be free from any openings;

a pair of spaced, parallel generally planar side walls extending outwardly from the peripheral edge of the top wall; and a pair of spaced, parallel generally planar end walls extending outwardly from the peripheral edge of the top wall, wherein each of the planar side walls and end walls has a lower free edge opposite the peripheral edge of the top wall, and wherein each of the lower free edges is curved outwardly and has a free end, each free end of the planar side walls being perpendicular to its respective planar side wall and each free end of the planar end walls being perpendicular to its respective end wall so as to form a plurality of lead-in features that aid in aligning and sliding the protective cover onto the pair of upstanding walls of the electrical connector, the pair of side walls engaging the outer surfaces of the upstanding walls of the electrical connector to removably secure the protective cover to the electrical connector, the protective cover having a mounted state, wherein the protective cover is mounted to the electrical connector such that the top wall, side walls and end walls of the protective cover completely enshrouds the electrical contacts to protect the electrical contacts from damage, prevent accumulation of dust particles on the electrical contacts, and prevent access to the electrical contacts and thereby use of the electrical connector, and a removed state, wherein the protective cover is removed from the electrical connector to allow access to the electrical contacts and thereby use of the electrical connector.

20. In combination:

an electrical connector for a printed circuit board, the electrical connector including:

a base wall;

a pair of spaced, parallel upstanding walls extending from the base wall, each upstanding wall having an inner surface and an opposite outer surface; and a plurality of exposed electrical contacts disposed on the base wall between the inner surfaces of the upstanding walls; and a static dissipative protective cover removably attachable to the electrical connector, the protective cover including:

a generally planar top wall having a peripheral edge, wherein the top wall is continuous so as to be free from any openings;

a pair of spaced, parallel generally planar side walls extending outwardly from the peripheral edge of the top wall; and a pair of spaced, parallel generally planar end walls extending outwardly from the peripheral edge of the top wall, each planar end wall being secured to both adjacent side walls, wherein each of the planar side walls and end walls has a lower free edge opposite the peripheral edge of the top wall, and wherein each of the lower free edges is curved outwardly and has a free end, each free end of the planar side walls being perpendicular to its respective planar side wall and each free end of the planar end walls being perpendicular to its respective end wall so as to form a plurality of lead-in features that aid in aligning and sliding the protective cover onto the pair of upstanding walls of the electrical connector, the pair of side and end walls engaging the upstanding walls of the electrical connector to removably attach the protective cover to the electrical connector, the protective cover having a mounted state, wherein the protective cover is mounted to the electrical connector such that the protective cover completely enshrouds the electrical contacts to protect the electrical contacts from damage, prevent accumulation of dust particles on the electrical contacts, and prevent access to the electrical contacts and thereby use of the electrical connector, and a removed state, wherein the protective cover is removed from the electrical connector to allow access to the electrical contacts and thereby use of the electrical connector.

* * * * *